US006627072B1

(12) United States Patent
Ridge

(10) Patent No.: US 6,627,072 B1
(45) Date of Patent: Sep. 30, 2003

(54) FILTER SYSTEM FOR A PARAFFIN SPA

(76) Inventor: Robert A. Ridge, 1419 Big Stone Gap, Duncanville, TX (US) 75137

( * ) Notice: Subject to any disclaimer, the term of this patent is extended or adjusted under 35 U.S.C. 154(b) by 0 days.

(21) Appl. No.: 09/798,175

(22) Filed: Mar. 2, 2001

Related U.S. Application Data

(60) Provisional application No. 60/186,941, filed on Mar. 4, 2000.

(51) Int. Cl.[7] ..... A61H 35/00

(52) U.S. Cl. ..... 210/149; 210/167; 210/175; 210/186; 210/195.1; 210/232; 210/416.1; 210/446; 210/742; 210/773; 219/430; 219/435; 607/86; 607/87

(58) Field of Search ..... 210/149, 100, 210/97, 167, 103, 175, 184, 186, 194, 195.1, 195.2, 196, 232, 416.1, 488, 446, 489, 490, 500.21, 500.36, 503, 504, 506, 742, 773, 774, 777, 650; 219/430, 435; 607/81, 85–87

(56) References Cited

U.S. PATENT DOCUMENTS 4,010,734 A * 3/1977 Chayet
4,187,182 A * 2/1980 Rosenberg ..... 210/445
4,232,656 A * 11/1980 Teagan
4,252,591 A * 2/1981 Rosenberg ..... 156/203
4,479,874 A * 10/1984 Rosenberg et al. ..... 210/445
5,918,541 A * 7/1999 Ahnen
5,945,001 A * 8/1999 Schmidt ..... 210/650
5,950,647 A * 9/1999 Usher
6,001,245 A * 12/1999 Reich et al. ..... 210/168

* cited by examiner

*Primary Examiner*—Robert J. Popovics
(74) *Attorney, Agent, or Firm*—Roger N. Chauza, Esq.; Chauza & Handley, LLP

(57) ABSTRACT

A paraffin filter system (10) includes an in-line low-profile particulate filter (20) connected to a suction tube (14) which is used as an inlet to the paraffin filter system (10). A paraffin pump (54) pumps the melted paraffin from a paraffin spa (12) through the particulate filter (20) to a transfer container (11) via a discharge tube (22). A heater (78) is controlled by control logic (146) to operate in certain modes to melt any residual paraffin in the filter (20) and pump (54) before operation of the pump (54). The control logic (146) provides various modes of operation of the filter system (10) to assure that the system is ready to operate, irrespective of the operation of a control panel switch (6) by the user. When the paraffin is transferred back to the spa (12) from the transfer container (11), the melted paraffin is carried through a bacteria filter (21) in the filter system (10).

14 Claims, 6 Drawing Sheets

FILTER SYSTEM FOR A PARAFFIN SPA

RELATED APPLICATIONS

This U.S. Patent application claims the benefit of pending provisional patent application bearing application No. 60/186,941, filed Mar. 4, 2000, and entitled "Filter System For A Paraffin Spa".

TECHNICAL FIELD OF THE INVENTION

The present invention relates in general to health and beauty care apparatus, and more particularly to systems for cleaning and otherwise removing contaminants from melted paraffin as utilized in paraffin spas.

BACKGROUND OF THE INVENTION

Paraffin spas are commonly used in the health and beauty areas for providing a therapeutic effect to a person's hands or feet. A paraffin spa includes a container for heating paraffin, wax or other similar substances to a melting point of about 120° F. The paraffin spa is of a size sufficient for bathing therein a person's hand or foot. Special paraffins are commercially available that are colored and have aromatic scents and oils therein. The client simply immerses an extremity in the melted paraffin for a short period of time, and withdraws the extremity for allowing solidification of the paraffin to a warm pliable state. This procedure is continued until a few layers of warm paraffin coat the person's extremity. The coating of paraffin remains warm and pliable due to the temperature of the client's extremity. This treatment provides a soothing and pleasant sensation to the client, as well as a therapeutic effect for dry skin.

It can be appreciated that during successive uses of the paraffin bath, various particulate contaminants accumulate and remain in the paraffin material. These particulate contaminants generally settle to the bottom of the paraffin bath. Certain health considerations arise if the contaminants are not removed. Moreover, clients become hesitant to place their hands in a melted paraffin bath that has visible particulate matter therein. There are also concerns of passing bacteria from one client to another.

One technique for assuring that the client does not utilize the paraffin with contaminants therein is simply to periodically replace the entire bath of paraffin wax. The large chunk of paraffin, together with the contaminants, is simply removed from the spa and replaced with fresh paraffin. While this measure is effective, it is a costly procedure and the used paraffin must be disposed of in a proper manner. In accordance with another technique, the solidified paraffin is removed from the spa, together with the contaminants or residue that has settled to the bottom thereof. The particulate contaminants can then be scraped or otherwise removed from the chunk of paraffin and the remaining portion of the paraffin placed back in the spa container. In this procedure, the spa heater is activated for a short period of time to melt the paraffin sufficiently so that the solidified portion can be removed. Again, this is a time-consuming procedure, is only marginally effective, and results in a portion of the paraffin being discarded. This technique is only effective for removing particulate contaminants that are heavier than the paraffin, and that settle to the bottom of the spa container. Other particulate matter that is suspended in the paraffin thus remains when the solidified paraffin is returned to the spa container.

An important consideration in the use of heated paraffin is that if the material is to be reused, it should be substantially free of bacteria and other filterable particulate matter before reuse thereof. Even if the melted paraffin were to be poured through a filter medium and used thereafter, general purpose filters cannot remove the bacteria and other fine particulate matter. This presents an obvious health concern. Even if very fine filter mediums were to be used, they would quickly become clogged with the larger size particles, and such filters would have to be replaced frequently.

From the foregoing, it can be seen that a need exists for a new technique in which melted paraffin is easily filtered with a high efficiency, and returned to the spa container. Another need exists for a hot paraffin filter system which is fool proof and does not require a high degree of skill in the operation thereof. Yet another need exists for a paraffin filter system that is constructed so that the filter is easily replaceable, and the other parts of the system remain generally inaccessible to the user.

SUMMARY OF THE INVENTION

In accordance with the principles and concepts of the invention, there is disclosed a hot paraffin filtering system that overcomes the problems and disadvantages attendant with the prior art techniques.

In accordance with one embodiment of the invention, there is disclosed a hot paraffin filter system in which the melted paraffin is withdrawn from the spa container by way of a suction tube, the paraffin is filtered by the filter system, and is returned back to the spa container, all while remaining in the molten state.

The melted paraffin filtering system includes a portable housing having a replaceable filter in series with a pump for pumping the melted paraffin. The filter is connected at an input to the filtering system. The output of the paraffin pump returns the hot filtered paraffin, via a plastic discharge tube, to either the spa container or a separate container. The filtering system includes a heater and control system for elevating the temperature of the various components of the filter system to melt the residual paraffin contained therein, before the system can be placed into operation. The control system monitors the temperature of the filtering system to prepare it for operation, and does not allow the pump to be operated until the paraffin contained therein becomes liquefied. Once the filtering system has reached its operating temperature, the control system allows the operator to place the pump into operation. Moreover, the control system monitors the temperature of the system and controls both the heater and a fan to assure that operating temperature remains substantially constant. Once the filter system has been made operational, the temperature of the melted paraffin withdrawn from the spa is generally sufficient to maintain the operating temperature of the filter system. In this operating mode, the heaters are generally inactive, and a fan is operated to cool the paraffin pump.

The filter system is constructed as a double wall housing having an upper chamber and a lower chamber. The lower chamber houses the fan, pump and other components. The upper chamber houses a replaceable filter to which the suction tube is connected, and the stub end of a pipe to which the discharge tube is connected. A lid or cover can be placed on the housing to provide thermal insulation during a heating mode so that the residual paraffin in the pumping components can be quickly melted.

In one mode of operation, the suction tube is moved about the molten paraffin in the spa container to transfer the paraffin and any suspended or settled particles through the filter of the filter system. The pump in the filter system pulls the molten paraffin and any particulate contaminants through the suction tube, through the filter, and discharges filtered paraffin back to the paraffin spa container via an outlet discharge tube. After several filter operations, the filter can be replaced should it become clogged with filtered particulate matter.

In another embodiment, the filter system draws the contaminated paraffin from the spa container, through a particulate filter, and into a separate transfer container, which may or may not be heated. When all the filtered paraffin has been transferred to the transfer container, the particulate filter is replaced with a bacteria filter. The filter system is again activated, whereupon the paraffin is drawn from the transfer container by the filter system, through the bacteria filter, and discharged into the paraffin spa container. In this method of operation, both particulate matter and bacteria are removed from the melted paraffin and regenerated for reuse in the paraffin spa.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, elements or functions throughout the views, and in which.

DETAILED DESCRIPTION OF THE INVENTION

Figure 1A:
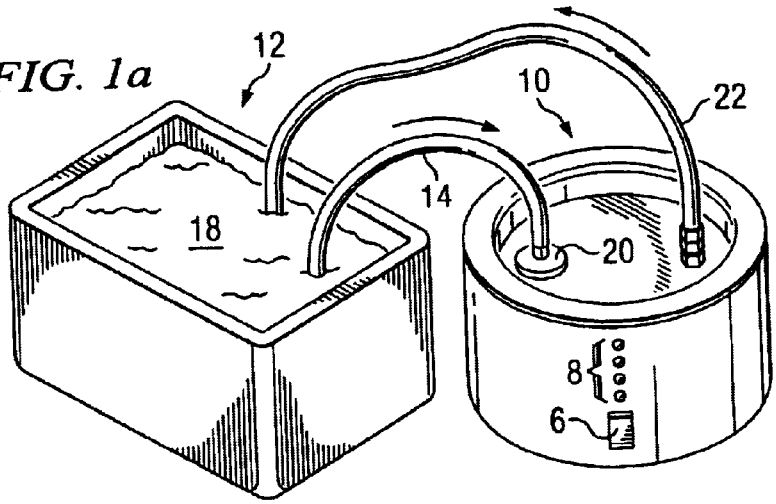
FIG. 1*a* illustrates a generalized view of a paraffin spa and a paraffin filtering system interconnected for filtering the melted paraffin according to one technique.
Figure 4A:
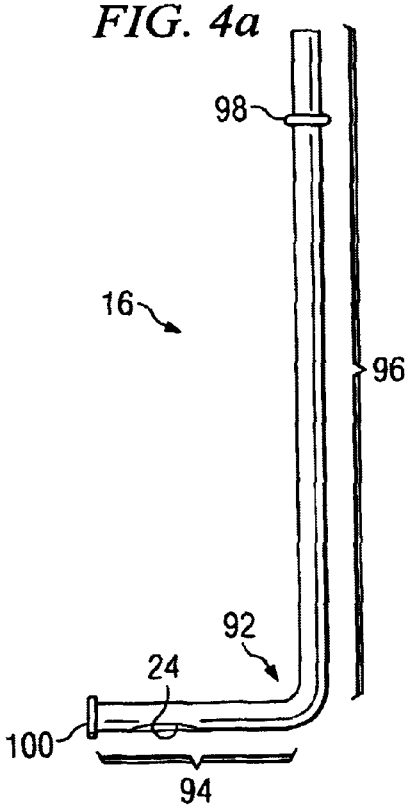
FIGS. 4*a* and 4*b* illustrate respective side and bottom views of the hand wand utilized for removing melted paraffin from the paraffin spa.

With reference to FIG. 1*a*, there is shown a paraffin filter system 10 interconnected with a paraffin spa 12. The paraffin filter system 10 is connected to the paraffin spa 12 by way of a suction tube 14 which may be optionally equipped with a hand-operated wand 16 (FIG. 4*a*). In the preferred form of the invention, the open end of the suction tube is simply immersed into the melted paraffin 18 of the spa 12. Melted paraffin 18 from the paraffin spa 12 is withdrawn therefrom and transferred through the flexible plastic suction tube 14 to a filter 20. A paraffin pump (not shown in FIG. 1) pulls the melted paraffin through the filter 20, and returns the filtered paraffin to the spa 12 via a plastic discharge tube 22. The arrows indicate the direction of the flow of melted paraffin in the tubes 14 and 22. During the filter operation, the open end of the suction tube 14 is manually moved about the bottom of the paraffin spa 12 to lift and remove the particulate matter. When all of the visible particulate matter has been removed, the suction tube 14 can be moved about the volume of melted paraffin 18, or left remaining therein for filtering substantially the entire contents of melted paraffin within the spa 12. According to this technique for removing particulate matter such as dirt and grime, the bath of paraffin 18 is never entirely removed so as to empty the spa 12.

In order to place the filter system 10 into operation, the paraffin spa 12 is activated so that the paraffin 18 becomes melted. This occurs when the paraffin reaches a temperature of about 120° F.–125° F. At the same time, the filter system 10 is activated by way of a manually-operated switch 6 to turn on the heaters and other sensors. The state or mode of the filter system 10 can be identified by various color-coded visual indicators 8. As will be described more thoroughly below, the operator cannot place the filter system 10 into a pumping and filtering mode, until such system has reached the desired operating temperature. The reason for this is that residual paraffin remains in both the replaceable filter 20 and the paraffin pump, and such paraffin cannot be moved or otherwise pumped until becoming liquefied.

Figure 1B:
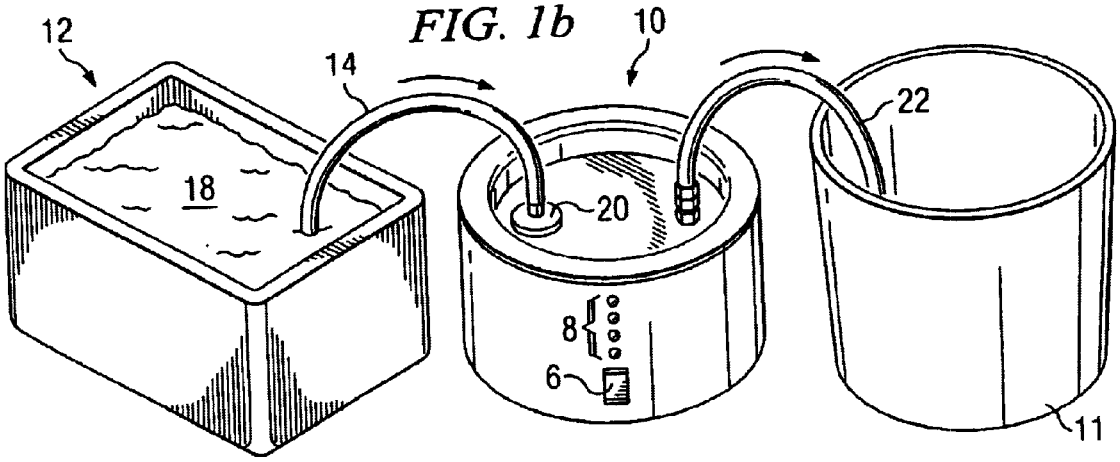
FIG. 1*b* illustrates another technique for transferring the melted paraffin through the filter system to a transfer container.
Figure 1C:
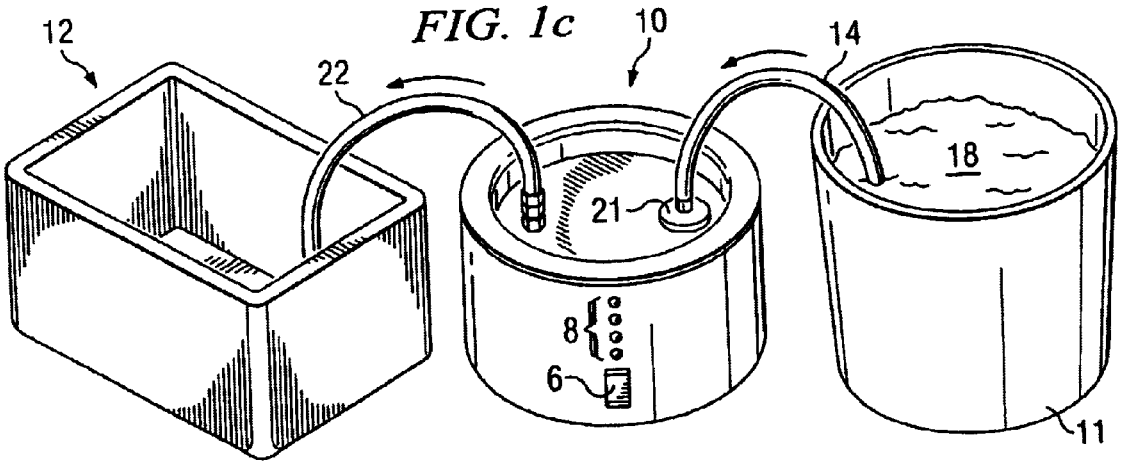
FIG. 1*c* illustrates the use of the filter system for transferring the filtered paraffin from the transfer container through the filter system for removing the bacteria, back to the paraffin spa.

FIG. 1*b* illustrates another method, including the connection between the paraffin spa 12 and the paraffin filter system 10. At this stage of the alternate method, the paraffin filter system 10 is equipped with a particulate filter 20 for removing dirt and grime from the paraffin before being transferred to a transfer container 11. Once the paraffin spa 12 is emptied of paraffin 18, and the filtered paraffin has been transferred to the transfer container 11, the particulate matter filter 20 is replaced with a bacteria filter 21. The paraffin spa 12 is then cleaned and disinfected. During this time, the suction tube 14 can be inserted into the melted paraffin of the transfer container 11 to recirculate the paraffin and maintain it in a molten state. As noted in FIG. 1*c*, the paraffin filter system 10 is activated to pump the filtered paraffin from the transfer container 11, through the bacteria filter 21, and back to the paraffin spa 12.

Figure 2:
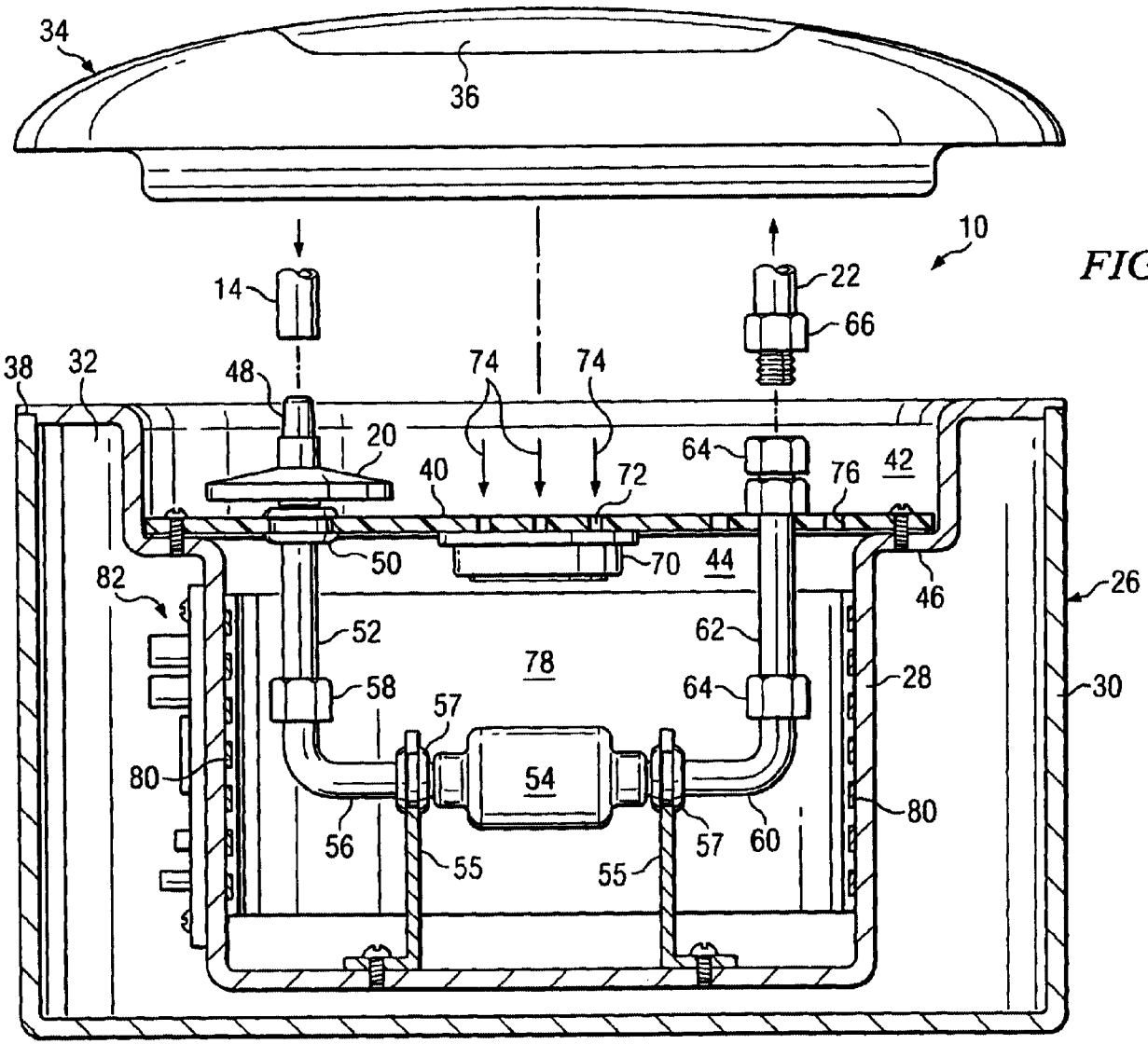
FIG. 2 illustrates a sectional view of the paraffin filtering system, showing the various components in the upper and lower chambers.

With reference now to FIG. 2, there is shown the details of the paraffin filter system 10. The filter system 10 includes a double-walled housing 26. The housing 26 includes an inner wall 28 and an outer wall 30. An air space 32 is formed therebetween, and functions to insulate the internal portion of the housing 26 to thereby reduce the loss of heat therefrom. A lid 34 is constructed to fit over the top of the housing 26, either when not in use or during a heating mode of the filter system 10. The lid 34 has a handle 36 for grasping. The housing 26 and lid 34 are injection molded from a suitable plastic material, such as polypropylene. The lid 34 is molded as a double wall structure to provide thermal insulation when the lid 34 covers the filter system 10. The inner sidewall 28 and outer wall 30 are formed separately and joined around the peripheral edge indicated by reference numeral 38. The inner and outer sidewalls 28 and 30 can be made with overlapping portions so as to be secured together by screws, or the like. A plastic divider 40 rests upon a peripheral ledge 46 formed in the inner sidewall 28. Again, the divider 40 is secured to the ledge 46 by screws, or the like. The divider 40 functions to provide an upper chamber 42 and a lower chamber 44 within the housing 26. In addition, the divider 40 provides a mechanism to which various components of the paraffin heating system 10 are supported. The divider 40 also functions to prevent access to the various components situated in the bottom chamber 44 of the paraffin filter system 10.

The plastic inlet suction tube 14 is connected to a tapered, tubular inlet portion 48 of the replaceable particulate filter 20. As will be described below, a bacteria filter 21 can be replaced with the particulate filter 20, and vice versa. A bottom tapered, tubular outlet (not shown) of the filter 20 is friction fit within a rubber grommet 50 supported within a hole formed in the divider 40. The grommet 50 is fixed to a copper tube 52, which forms an inlet to a paraffin pump 54. The inlet copper tube 50 is suitably fastened to a pump inlet 56 by an appropriate coupling 58. The paraffin pump 54 is mounted to the bottom of the inner sidewall 28 by a pair of L-shaped brackets 55. The pump inlet and outlet are cradled in the brackets 55 by respective rubber grommets 57. The paraffin pump 54 is of a general purpose type of pump commonly utilized in pumping hot liquids. In the preferred form of the invention, the internal motor of the pump 54 is a solenoid-operated, piston-type of motor. The pump 54 is driven by half-wave rectified 110 volt AC power. The reciprocating solenoid follows the AC cycle, and thus provides 60 reciprocations per second. Such type of pump typically includes an internal valving arrangement to provide the appropriate inlet of a hot liquid into a pumping chamber at the appropriate portion of the pumping cycle. In practice, a pump providing about 0.3 gallon per minute capacity is suitable for filtering the volume of melted paraffin typically found in paraffin spas. An outlet 60 of the pump 54 is coupled to an outlet copper tube 62 by way of a suitable coupling 64. The outlet copper tube 62 extends upwardly through an opening in the divider 40. The end of the outlet tube 62 is fastened to an internally threaded coupling 64. The coupling 64 facilitates the manual fastening thereof to the discharge plastic tube 22. The end of the outlet discharge tube 22 is fastened by suitable means, such as a hose clamp, to a nylon fitting 66 which has male threads that mate with the coupling 64. Both the suction tube 14 and the discharge tube 22 are plastic tubing of about three eights inch in diameter.

A muffin-type fan 70 is fastened to the bottom surface of the divider 40. A number of openings 72 are formed in the divider 40 so that air can be pulled therethrough by the fan 70 in the direction of arrows 74. The fan 70 can thus pull air at an ambient temperature through the divider 40 to cool the pump 54 located directly below the fan 70.

The divider 40 includes another set of openings, one identified as reference numeral 76, through which air circulates upwardly from the bottom chamber 44. The warm air that exits the divider 40 via the openings 76 tends to heat the replaceable filter 20 and maintain the paraffin therein in a liquid form. As will be described in more detail below, when the paraffin filter system 10 is in a heating mode, heat is generated in the bottom chamber 44 to melt the wax in the lines 52 and 62 as well as the residual paraffin remaining in the pump 54. The fan 70 draws air into the bottom chamber 44 where it becomes heated, and exits via the openings 76 in the divider 40. This circulation of hot air maintains the temperature within the bottom chamber 44 at a desired level, as well as maintains the filter 20 at a temperature which keeps the paraffin therein melted. As will be described below, a thermistor is mounted to the frame of the pump 54 to thereby monitor the temperature thereof. The temperature of the pump case is used as an indication of the temperature in the bottom chamber 44.

Fastened within the bottom chamber 44 is a pair of flexible heating elements, one shown as reference numeral 78. The heating element 78 includes a plurality of resistive conductor strips 80 through which current flows to produce thermal energy. The heating element 78 includes a Mylar plastic backing with conductive ink formed in strips and covered thereover with another protective plastic coating. The heating element 78 is bonded to the internal surface of the inner sidewall 28, in the bottom chamber 44. Another similar heating element (not shown in FIG. 2) is bonded to the opposing inner surface of the inner sidewall 28. Fastened within the space 32 between the inner sidewall 28 and the outer sidewall 30 is a printed circuit board 82 having components mounted thereon. The printed circuit board 82 includes control circuitry for controlling the operation of the pump 54, the fan 70, and the heating element 78, in response to the temperature sensor and the push button switch 6. The printed circuit board 82 includes generally all of the circuits shown in block form in FIG. 7.

Figure 3A:
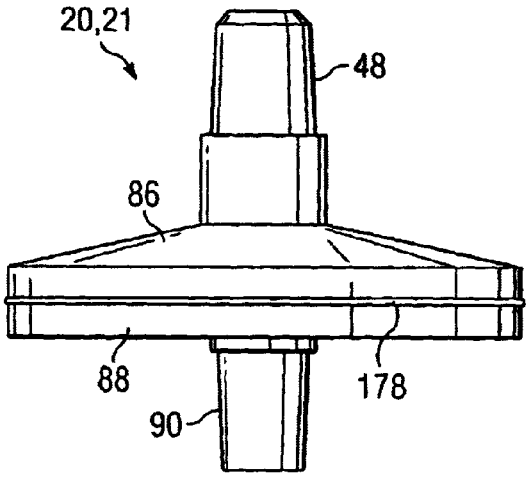
FIGS. 3*a*–3*f* illustrate various views of the replaceable filters utilized in the paraffin filter system.
Figure 3B:
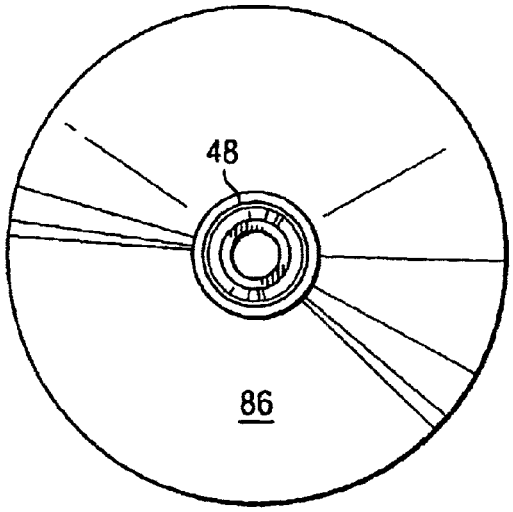
Figure 3C:
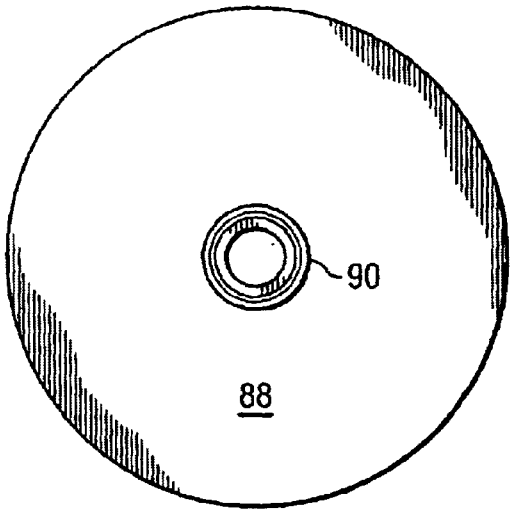

FIGS. 3*a*–3*c* illustrate the low profile replaceable filter 20, constructed in accordance with the invention. The filter 20 is constructed of molded plastic halves, including a top cap 86 and a bottom cap 88. The filter caps 86 and 88 are bonded together around a peripheral seam 178 thereof, with the filter medium sandwiched therebetween. The filter 20 includes a top tubular inlet 48 to accommodate the friction fit of a three-eights (3/8) inch plastic tubing. The bottom cap 88 includes a tapered tubular outlet of about a five-sixteenths (5/16) inch diameter. The outlet 90 is press fit into the opening of the grommet 50, shown in FIG. 2. The outside diameter of the body of the filter 20 is about forty-seven millimeter (47 mm). Formed within each filter caps 86 and 88 are support ribs 174 and 176 for supporting the filter medium as the liquefied paraffin passes therethrough. When used to remove particulate matter from the paraffin, the filter medium can be equipped with a material that is effective to filter particles of 10–150 micron, or larger. When used to remove bacteria, after the larger particulate matter has been removed, the filter medium can be constructed with a material that is capable of removing bacteria from the paraffin. The bacteria filter 21 is otherwise identical in construction to the particulate matter filter 20, except also for color coding of the two filters. While a low profile filter 20 is utilized in conjunction with the preferred form of the invention, other standard filters can be utilized.

Figure 3D:
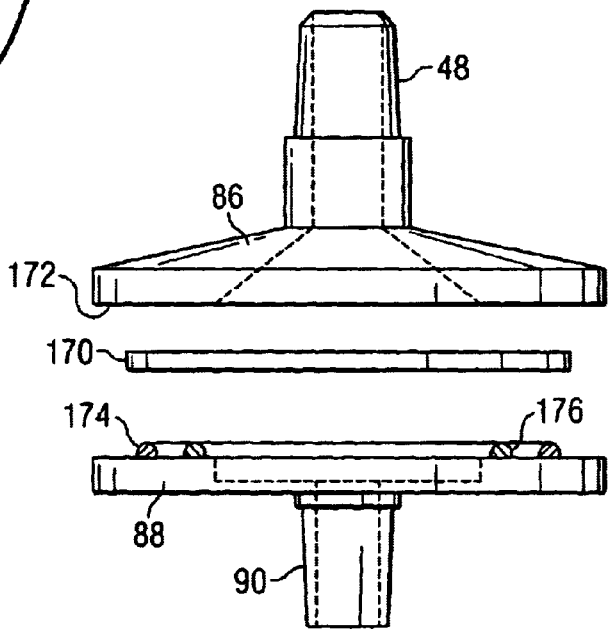

FIG. 3*d* illustrates a manner in which the plastic filter caps 86 and 88 hold the filter medium 170 therebetween. The filter medium 170 can be constructed to filter either particulate matter such as dirt and grime, or very small particles such as bacteria. The top filter cap 86 is constructed with essentially a smooth annular surface 172. The bottom filter cap 88 has formed on a flat annular surface 174 a pair of concentric annular ridges 174 and 176. The annular ridges 174 and 176 function to provide an annular seal around the filter medium 170 when the top filter cap 86 and bottom filter cap 88 are forced together and mechanical welded by ultrasonic welding techniques. The top and bottom filter caps 86 and 88 are welded around the annular edge, at the interface 178, such as shown in FIG. 3*a*. The outside diameter of the annular edges of the top cap 86 and bottom cap 88 are about 47 mm. The diameter of the effective filter area inside the inner annular ridge 178 is about 35 mm. The construction of the filter mediums 170 are described in detail below.

Figure 3E:
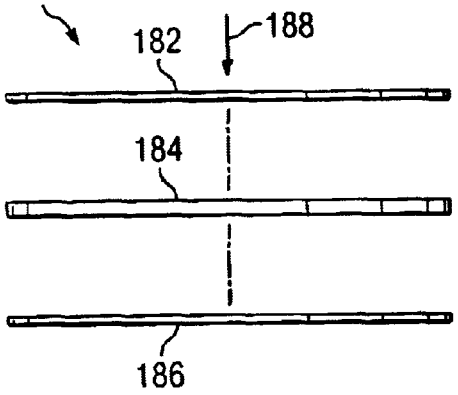

FIG. 3*e* illustrates the particulate filter medium 180 of the particulate filter 20. The filter medium 180 for the particulate filter 20 includes three members. A top member of the filter medium 180 comprises a spun-bonded polyester, compressed to form a rigid wafer of about 12 mils thick. The polyester layer 182 is of a 2033 polyester, obtained from Midwest Filtration, Fairfield, Ohio. The polyester filter layer 182 is effective to filter material of about twenty-five micron or larger. A second layer 184 of the filter medium 180 comprises a one-hundred percent polyester felt material that is porous and pliable so as to have a sponge-like consistency. The polyester felt material 184 functions to wet the top surface of the underlying polypropylene filter membrane 186. The polyester felt material 184 is of the type having a thickness of about 0.060 before being compressed between the top filter cap 86 and the bottom filter cap 88, and is about 10 mils thick after compression when the ultrasonic process welds the filter caps 86 and 88 together.

The bottom filter layer 186 constructed of the polypropylene material is effective to filter particles of about 10 microns, and greater in size. The filter membrane 186 is obtainable from Gelman Laboratory, Inc. as part number #61757. The thickness of the polypropylene filter member is about 0.003 inches thick. The filter medium 180 is directional in nature, in that the liquefied paraffin must be pulled or otherwise forced through the filter 20 in the direction of arrow 188. During assembly, the three layers, 182, 184 and 186 are arranged in the manner indicated in FIG. 3*e* , and centered between the top filter cap 86 and the bottom filter cap 88. The filter caps 86 and 88 are then pressed together with a suitable pressure and subjected to an ultrasonic bonding operation around the seam 178 of the filter caps.

In accordance with an important features of the invention, the polyester felt material 184 functions to accumulate the liquefied paraffin when the initial surge of paraffin is forced through the filter 20. The initial surge of paraffin is soaked up into the polyester felt material 184, which sufficiently warms the polypropylene filter membrane 186 so that solidification of the initial front of the paraffin does not occur. Otherwise, instances may occur where the liquefied paraffin initially solidifies on the filter membrane 186 and thereby prevents further flow of liquefied paraffin through the filter 20. With the use of these materials for the particulate filter medium 180, the build-up or generation of static electricity during flow of the paraffin is substantially reduced.

Figure 3F:
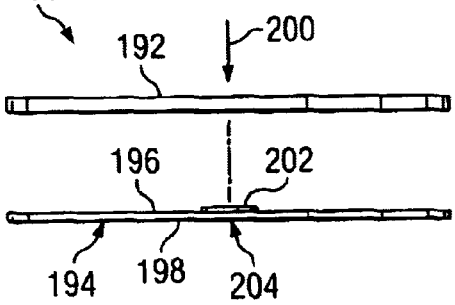

FIG. 3*f* illustrates the construction of the bacteria filter medium 190 for use in the bacteria filter 21. The bacteria filter medium 190 also includes a polyester felt material layer 192 of the same construction described above in connection with the particulate filter medium 180. Again, the polyester felt material 192 prevents initial solidification of the melted paraffin front, as well as a substantial reduction in the static electricity generated thereby.

The bacteria filter medium 190 also includes a bacteria filter membrane 194. The bacteria filter membrane 194 is effective to filter bacteria having a size of about three microns, or greater. The bacteria filter membrane 194 is obtainable from Gelman Laboratories, as part number #66387, known as Versapor 3000T. Such type of bacteria filter membrane is used in a conventional manner for filtering blood. The bacteria filter membrane 194 includes a frontal carrier material 196 that is coated on the backside thereof with a powdered filter media 198. It is important that the melted paraffin flows through the bacteria filter medium 190 in the direction shown by arrow 200. In order to verify that the bacteria filter medium 190 is oriented correctly between the top filter cap 86 and bottom filter cap 88, two visual indicators are utilized. First, a red adhesive color dot 202 is fixed in the center of the top surface of the bacteria filter membrane 194. By illuminating the top opening of the assembled filter cap 86 of the bacteria filter 21, the red color dot 202 should not be seen if the bacteria filter 21 is correctly assembled. The polyester felt material layer 192, if present, hides the red color dot 202 located on the top surface of the underlying bacteria filter membrane 194. In addition, during fabrication of the bacteria filter membrane 194, a green ink spot 204 is placed on the bottom surface, in the center thereof. By illuminating the bottom opening of the assembled filter cap 88, the green ink can be seen and it can be verified that the bacteria membrane 194 is oriented correctly within the filter caps 86 and 88. If the red color dot 202 is observed through the opening in the bottom filter cap 88, it is confirmed that the bacteria filter membrane 194 is up side down. Should the bacteria membrane 194 be assembled in a reverse manner so that the powdered filter media 198 is on the inlet side of the filter membrane 194, the bacteria filter membrane 194 will be rendered ineffective to remove bacteria from the melted paraffin. By use of these color mechanisms, the presence and the proper orientation of the filter layers can be verified after complete assembly of the bacteria filter 21.

In the event it is desired to filter particles of sizes smaller than about 150 micron, a series of filter mediums with successively smaller porosities can be utilized. If bacteria, having a particle size of at least three microns is to be removed from the melted paraffin, then suitable filter mediums are available. In order to prevent an excessive buildup of the filtered particles on one side of the filter medium, which would otherwise retard the volume of flow therethrough, a number of filter mediums can be utilized in series, each with a different porosity. For example, three different filter mediums can be placed one over the other, each spaced apart from each other to allow for the accumulation of particulate matter on the frontal or inlet side thereof. The first inlet filter medium can be of a porosity to filter and otherwise remove particles of 150 micron or larger. The middle filter medium can be of a porosity for filtering 50 micron size particles. Lastly, a third filter medium having a porosity for filtering 3 micron size particles can be utilized to prevent the passing therethrough of bacteria. Those skilled in the art may prefer to utilize other filter schemes, each of which could be applicable to the invention.

Figure 4B:
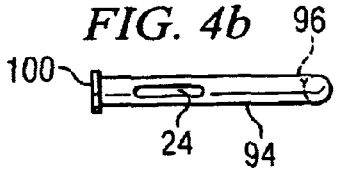

FIGS. 4*a* and 4*b* illustrate the hand-held wand 16 utilized for suctioning the liquefied paraffin 18 and particulate matter that may settle to the bottom of the paraffin spa 12. As noted above, the use of the wand 16 is optional. The wand 16 is constructed of a rigid tubular material, which includes a right-angle bend 90 to form a horizontal portion 94 that can be swept across the bottom of the container of the paraffin spa 12. The upright portion 96 of the wand 16 includes a sleeve 98 for providing a friction fit of the plastic suction tubing 14 thereto. The upright portion 96 of the wand 16 can be held by the user for moving the wand 16 about the melted paraffin 18. The end of the horizontal portion 94 is plugged with a cap 100. As noted above, formed in the bottom of the horizontal portion 94 is a slot 24 providing an opening through which liquefied paraffin is drawn. With this arrangement, it is assured that the melted paraffin 18 and the particulate matter settled to the bottom of the paraffin spa 12 is first picked up and removed through the slotted opening 24 of the wand 16.

Figure 5:
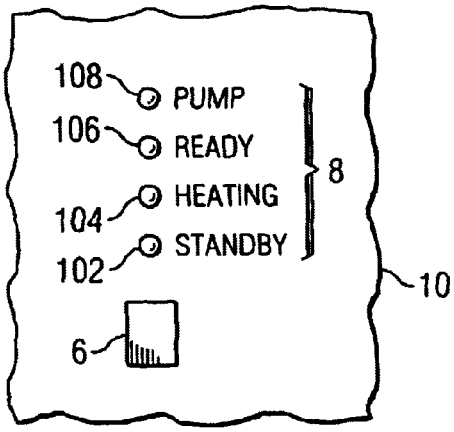
FIG. 5 illustrates a partial frontal view of the paraffin filtering system control panel, showing the status of the filtering system.

FIG. 5 shows a portion of the outer housing 30 with the various operator controls mounted therein. A momentary-push button 6 is mounted within the housing so as to be operable by the user. A first visual indicator 102 constitutes a yellow lamp or LED to identify a standby mode of the filter system 10. A second visual indicator 104 constitutes a red LED showing the heating mode of the system. A third visual indicator 106 is a green LED showing a ready state of the system. A fourth visual indicator 108 is an amber LED showing a pumping mode of the filter system 10.

In operation, when the paraffin filter system 10 has not been operational for a period of time and the push button 6 has not been actuated, the standby mode is in effect, in which event the first indicator 102 is illuminated. If it is desired to place into operation the filter system 10, the lid 34 is placed on the double wall housing 26 and the push button switch 6 is depressed once. The inlet suction tube 14 can also be placed fully inside the upper compartment of the filter system to heat the suction tube 14 and prevent solidification of paraffin as it initially passes therethrough. The control system mounted on the printed circuit board 82 causes the heating mode to be entered, in which event the red indicator 104 is illuminated. In the heating mode, the heating element 78 and the other heating element (not shown) are energized so that current flows therethrough and thermal energy is generated in the bottom chamber 44. In this mode, the fan 70 is activated to circulate the warm air between the top chamber 42 and the bottom chamber 44 of the filter system 10. When the residual paraffin in the system 10, and particularly that in the filter 20, the pump 54 and the input and output lines 52 and 62 reaches about 160° F., as sensed by a thermistor mounted to the case of the pump 54, the ready indicator 106 is illuminated. It should be noted that only one indicator is illuminated at a time, and that the system cannot proceed to the next mode or state until predetermined conditions are satisfied, even if the operator continues to push the switch 6. When the components of the filtering system 10 reach a temperature of 160° F., the heating indicator 104 is extinguished, and the ready indicator 106 is illuminated. This indicates that the system is ready to transfer melted paraffin 18 from the paraffin spa 12 to the filter system 20, by way of the paraffin pump 54.

When in the ready mode, the lid 34 of the filter system 10 can be removed, and the plastic tubes 14 and 22 can be attached to the respective filter 20 and outlet pipe 64 of the paraffin filter system 10. According to the first method (FIG. 1*a*), the open end of the suction tube 14 and the open end of the discharge tube 22 can be simply suspended within the melted paraffin 18 of the spa 12. Particulate matter is removed from the paraffin in this operation, and the spa 12 is not emptied. With this arrangement, the melted paraffin is removed from the spa 12 and filtered to remove particulate matter, and returned back to the spa 12 without emptying.

In another method (FIGS. 1*b* and 1*c*), the filtered paraffin is transferred by the paraffin filter system 10 for intermediate holding to a transfer container 11. In this situation, the outlet discharge tube 22 is suspended in the transfer container 11, rather than in the spa 12.

Once one of these arrangements is accomplished, the operator can depress the switch 6, whereupon the filter system 10 is placed in a pumping mode. The pump indicator 108 is illuminated. In the pump mode, the reciprocating pump 54 is activated to thereby draw the melted paraffin 18 from the spa 12 through the particulate filter 20, and either return the filtered paraffin 18 back to the spa via the discharge tubing 22, or to the transfer container 11 via the discharge tubing 22. The filter system 10 can operate continuously in the pump mode, where the melted paraffin 18 is transferred at the rate of about 0.3 gallon per minute. Paraffin spas of the standard volume can be cleaned of particulate matter within several minutes. During the pumping mode of the filter system 10, the fan 70 continues to operate to circulate ambient air over the paraffin pump 54, and exhaust the higher temperature air into the first chamber 42, via the openings 76 in the divider 40. In practice, it is found that the temperature of the melted paraffin 18 passing through the pump 54 is adequate to maintain the bottom chamber 44 at a temperature sufficient to keep the paraffin 18 in a melted state. In addition, the pump 54 generates a sufficient amount of wattage, in the neighborhood of 50 watts, to keep the temperature in the bottom chamber 44 at about 160° F. Indeed, the temperature of the lower chamber 44 can be regulated, in that the thermistor mounted to the pump 54 can signal the control logic on the printed circuit board 82 to interrupt the power coupled to the heating elements 78. In any event, the temperature within the lower chamber 44 is controlled within a desired range so that the paraffin 18 remains in a melted state, but excess temperatures are not generated which would otherwise degrade the life of the components.

When the paraffin filtering operation is completed and the particulate matter is removed therefrom, the suction tube 14 is lifted out of the melted pool of paraffin so that the pump 54 can be cleared as much as possible of residual paraffin. This switch 6 is then operated, in which event the control logic on the printed circuit board 82 places the filtering system 10 in the ready mode. The pump indicator 108 is extinguished, and the ready indicator 106 is illuminated.

The pumping operation can again be initiated with respect to another paraffin spa, or if the second method of operation has been chosen, then filtered paraffin can be transferred from the transfer container 11, through a bacteria filter 21, and returned to the paraffin spa 12. In this type of operation, the particulate filter 20 in the filter system 10 is replaced with a filter 21 effective to remove bacteria from the paraffin. If the bacteria filtering operation is commenced within a short period of time, the switch 6 is again depressed. In this event, the filtering system 10 is again placed in a pump mode, in which event the pump indicator 108 is illuminated and the pump operates to pump paraffin. In the ready state of the filter system 10, pumping can be initiated without re-entering the heating mode. The ready state of the filter system 10 is configured to last for about two minutes. If the filter system 10 is in the ready state, and is not placed in the pumping state within about two minutes, the system will return to the standby state. This is a safeguard to prevent entering of the pumping mode by the pump should the paraffin cool and begin to solidify. In a transition from the ready state back to the standby state, and should the push button 6 be depressed, the heating state will again be initiated to bring the operating temperature 44 up to about 160° F. to assure that the residual paraffin is again melted. Upon a subsequent depression of the switch 60, the filter system 10 then re-enters the pump state.

In any event, and in accordance with the second arrangement when it is desired to not only remove particulate matter from the melted paraffin, but also to remove bacteria, the paraffin from the spa 12 is first transferred through the particulate filter 20 of the filter system 10. All of the melted paraffin is removed in this manner and transferred through the particulate filter 20 to the transfer container 11. The spa 12 is then cleaned of all residue paraffin, and thereafter sanitized and disinfected by conventional solutions to remove all bacteria from the spa bath surfaces. The particulate filter 20 of the filter system 10 is replaced with a bacteria filter 21, and the discharge tube 22 is emptied and also sanitized. The particulate filter 20 and the bacteria filter 21 are preferably color coded so as to be distinguishable from each other. Before the melted paraffin in the transfer container 11 begins to solidify, the suction tube 14 is suspended in the melted paraffin of the transfer container 11, and the outlet discharge tube 22 is suspended in the paraffin spa 12.

The transfer container 11 can be heated, if necessary, to maintain the paraffin in the molten state. The filter system 10 is activated, whereupon the paraffin is transferred from the transfer container 11, through the bacteria filter 21, and returned to the paraffin spa 12. Once completed, the filter system 10 is allowed to return to a standby state.

Figure 6:
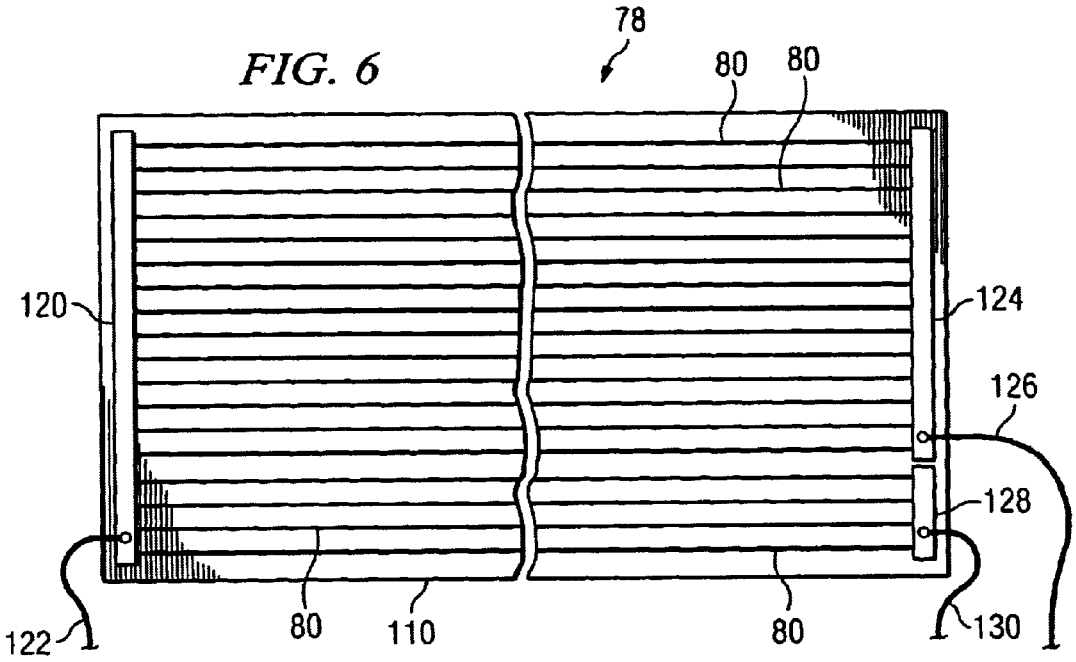
FIG. 6 illustrates a frontal view of one flexible heating element utilized in the paraffin filter system.

With reference back to the apparatus of the filter system 10, there is shown in FIG. 6 one of the pair of heating elements 78. One heating element is bonded to the inner sidewall 28 in a semicircle, and the other heating element is bonded to the other semicircle of the inner sidewall 28. As noted above, the heating element 78 is constructed with a Mylar or other suitable plastic backing 110. Resistive ink conductors 80 are deposited on the Mylar backing 110 in a standard manner. In the preferred form of the invention, there are eighteen resistive conductors 80 associated with each heating element 78. A transverse shorting bus 120 causes one end of each resistive conductor 80 to be short circuited together. A wire conductor 122 soldered to the transverse bus 120 can be connected to the control logic mounted on the printed circuit board 82. One or more shorting bars can be formed at the other end of the resistive conductors 80 to short circuit groups of resistive conductors 80. In the heating element 78 shown in FIG. 6, one shorting bus 124 is effective to short circuit fourteen resistive conductors 80. Wire conductor 126 soldered thereto is connected to the control logic. A second shorting bus 128 is effective to short circuit four resistive conductors 80. A wire conductor 130 soldered thereto is connected to the control logic. Each resistive conductor 80 is formed in a well known manner with ink such that the resistance of each conductor is about 7800 ohm. Thus, by shorting together an appropriate number of resistive conductors, composite resistive values can be achieved.

It can be appreciated that when electrical current is switched through these groups of resistive conductors 80, a corresponding amount of thermal energy is generated. In accordance with an important feature of the invention, some of these groups of resistive conductors are connected in series with various components of the filter system 10. For example, one twelve-conductor group is connected in series with the fan 70. This allows a low voltage fan motor to be operated from a higher voltage source. Thus, whenever the fan is activated, a corresponding amount of heat is generated by this group of resistive conductors 80. Another group of four resistive conductors is connected in series with the input power to the printed circuit board 82 In powering the printed circuit board 82, especially in the standby mode, the four resistive conductors connected to the bus 128 provide a sufficient amount of heat in the bottom chamber 44 maintain a given temperature. Yet another group of resistive conductors can be connected in series with the paraffin pump 54.

As noted above, another heater element is utilized in the bottom chamber 44, and is bonded to the inner sidewall in a location opposing that of heater element 78 shown in FIG. 2. There is again one common bus bar at one end of the resistive conductors. At the other end of the resistive conductors of this other heater element, there are also two separate conductive bars, each short circuiting respective twelve resistive conductors and six resistive conductors. The bus bar connecting together the twelve resistive conductors form a composite resistor in series with the fan 70. The other six resistive conductors are switched on during the heating mode to thereby supply additional thermal energy to the bottom chamber 44.

Figure 7:
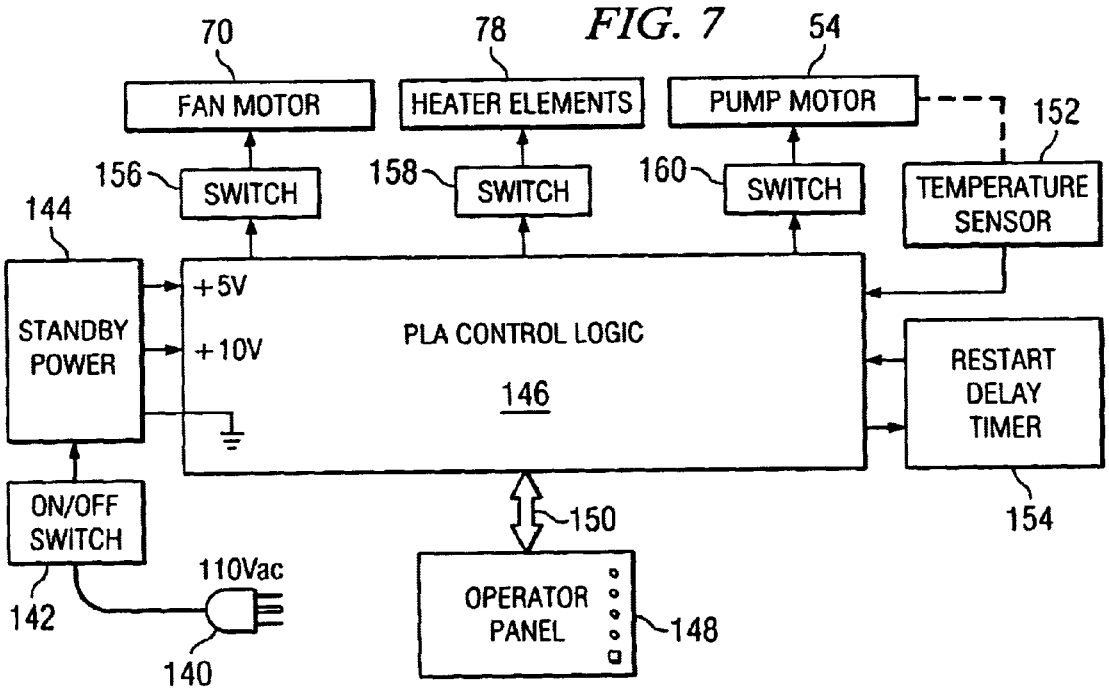
FIG. 7 illustrates a block diagram of the control system for electrically controlling the paraffin filter system.

The control and other circuits located on the printed circuit board 82 are shown in FIG. 7. A 110 volt ac plug 140 is connected to an on/off switch 142 for controlling ac power to a standby power supply 144. The standby power supply 144 provides five and ten volt DC power to a PLA control logic section 146. The control logic 146 includes various gates, counters, timers to provide the functions noted above. The operator controls 148 is coupled to the control logic via a bus 150. The thermistor temperature sensor 152 is fastened to the case of the pump 54, and is wired to the control logic 146 to provide indications of the temperature in the bottom chamber 44 of the housing 26. A restart delay timer 154 is connected to the control logic 146. The restart delay timer 154 functions to establish the amount of time of inactivity in the ready mode before the filter system 10 can reenter the pumping mode without having to proceed through the heating mode. A first FET switch 156 is controlled by the control logic 146 to activate the fan 70. A second FET switch 158 is controlled by the control logic 146 to activate the heater elements 78. A third FET switch 160 is connected to the control logic 146 to activate the paraffin pump 54. While not shown, there are circuits for generating rectified 110 vac power for powering the 24 volt fan 70 in series with a resistive conductor group. The heater elements 78 and the pump 54 are also powered by rectified ac signals.

While the foregoing illustrates the filter system 10 constructed separate from the paraffin spa, it could be incorporated as well into the spa. Also, the discharge tube 22 can be utilized to dispense warm paraffin directly on to the various body parts of a client. A flow control device, such as a valve, can be utilized in the paraffin pumping line to control the volume of warm paraffin dispensed.

Figure 8:
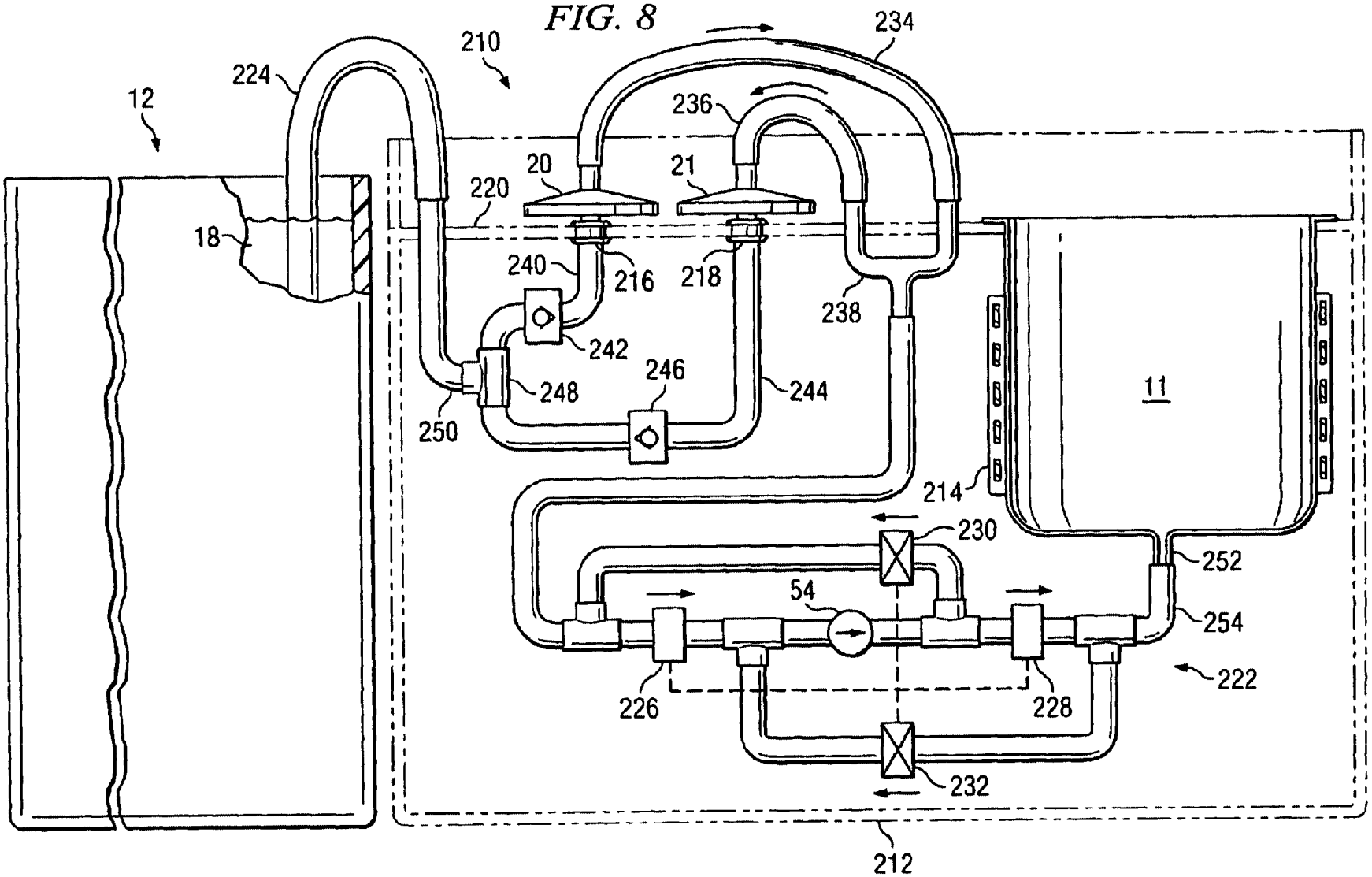
FIG. 8 illustrates in diagrammatic form the integration of the paraffin filter system and the transfer container, and the valving arrangement to simplify the removal of particulate matter and bacteria from the paraffin.

FIG. 8 illustrates yet another embodiment of a paraffin filter system 210 of the invention. Here, the transfer container 11 is housed within the plastic case 212 of the filter system 210. The transfer container 11 may or may not include a heater 214 that maintains the paraffin held therein in a molten state. Both the particulate filter 20 and the bacteria filter 21 are mounted in respective grommets 216 and 218 in the divider 220. The particulate filters 20 and 21 are replaceable in the same manner noted above. With the paraffin filter system 210 shown in FIG. 8, both the particulate filtering and the bacteria filtering steps can be carried out in a convenient manner.

The paraffin pump 54 is connected to a valving arrangement 222 such that the liquefied paraffin can be transferred from the paraffin spa 12 to the transfer container 11, via the particulate filter 20, and then reversed so that the filtered paraffin can be pumped from the transfer container 11 back to the paraffin spa 12 via the bacteria filter 21. A single flexible tube 224 is thus utilized in the transfer of the melted paraffin in both directions.

The control windings of valve 226 and valve 228 are connected together so as to be controlled in unison. In like manner, the control windings of valve 230 and 232 are coupled together and controlled so as to also operate in unison. Valves 226 and 288 are controlled so as to be open when valves 230 and 232 are closed, and vice versa. This arrangement allows the paraffin pump 54 to reverse the direction of the paraffin flow in the flexible tubing 224. Those skilled in the art may prefer instead of using the valving arrangement 222 to employ a pair of paraffin pumps, one operable to pump the paraffin each direction.

Flexible tubing 234 is coupled to the outlet of the particulate filter 20, while flexible tubing 236 is coupled to the input of the bacteria filter 21. These flexible tubings 234 and 236 are accessible to the operator for allowing easy replacement of the filters 20 and 21. The other ends of the tubes 234 and 236 are connected together by a T-connection 238 and routed to the valving arrangement. The input of the particulate filter 20 is coupled by a metal tube 240 to a check valve 242. In like manner, the output of the bacteria filter 21 is coupled by a metal tube 244 to a respective check valve 246. The input of check valve 242 and the output of check valve 246 are coupled together by a T-connection 248. One end of the flexible tube 224 is connected to the upper end of a metal tube 250 that protrudes from the top surface of the divider 220. The other end of the flexible tube 224 is suspended within the paraffin spa 12 for a portion of the filter cycle, then is place within the molten paraffin of the transfer container 11 during another portion of the filter cycle.

One input/output end of the valve arrangement 222 is connected to the T-connection 238. The other input/output end of the valve arrangement 222 is coupled between the paraffin pump 54 and a bottom inlet/outlet 252 of the transfer container 11 by way of a tube 254.

The operation of the paraffin filter system 210 is carried out in the following manner. It is understood that the various heater and other electrical control systems shown in FIGS. 2 and 7 can be utilized in conjunction with the paraffin filter system 210 of FIG. 8. In addition, the control panel may also include a switch for placing the system 210 in a particulate filter mode and another switch for placing the system 210 in a bacteria filter mode. In any event, when it is desired to filter the melted paraffin in the paraffin spa 12, the paraffin filter system 210 can be placed into operation in the same manner described above, and also by depressing the particulate filter switch (not shown). The valves 226 and 228 will thus be open, and the other valves 230 and 232 will be closed. In the operation of the pump 54, melted paraffin 18 is drawn in the flexible tubing 224 from the spa 12 through the check valve 242 and then through the particulate filter 20. After the particulate matter is filtered from the melted paraffin by filter 20, it is drawn through the tubing 234 to the valving arrangement 222. Because the valves 226 and 228 are open, the melted paraffin is drawn therethrough by the pump 54 to the tubing 254 and into the transfer container 11 by way of the inlet/outlet 252. Once all of the melted paraffin has been filtered to remove the particulate matter and transferred to the transfer container 11, the paraffin spa 12 is cleaned and disinfected in the manner described above. During the cleaning of the paraffin spa 12, the end of the flexible tubing 224 can be placed in the transfer container 11 to recirculate the melted paraffin in the filter system 210 and maintain the paraffin in a melted state.

Once it is desired to transfer the filtered paraffin back to the spa 12, the bacteria filter switch (not shown) can be depressed by the operator. When the bacteria filter switch is depressed, the valves 226 and 228 close, and the valves 230 and 232 are opened. With this arrangement, the operation of the paraffin pump 54 causes the melted paraffin to be drawn out of the transfer container 11 via tube 254, and pumped through the valves 232 and 230 to the bacteria filter 21 via tubing 236. The melted paraffin pumped through the bacteria filter 21 proceeds through the check valve 246 and is transferred back to the paraffin spa 12 via the flexible tubing 224. It is noted that the check valve 242 prevents the paraffin from being pumped backwards through the particulate filter 20 in this cycle of operation. When the melted paraffin has been completely transferred from the transfer container 11 to the paraffin spa 12, the system can be shut off. The used bacteria filter 21 can then be disconnected from the grommet 218 and from the respective tubing 236, and replaced. If needed, the particulate filter 20 can also be replaced in a similar manner.

While the valving arrangement 222 is illustrated in FIG. 8 as four individual valves, different types of valving arrangements can be utilized to provide bidirectional pumping of paraffin using a unidirectional pump 54. Various types of spool valves or manual-operated valves can be utilized to accomplish the function described above. Optionally, the tubing 250 can also be connected by way of a valve (not shown) to a second inlet of the transfer container 11, so as to provide automatic recirculation of melted paraffin while the paraffin spa 12 is being disinfected, without placing the end of the tubing 224 manually in the paraffin of the transfer container 11. The valve in this optional arrangement can either be controlled manually or automatically by control systems sensing when the paraffin spa 12 is empty and when paraffin is not being pumped by the pump 54.

Although the preferred embodiment has been described in detail, it should be understood that various changes, substitutions and alterations can be made therein without departing from the spirit and scope of the invention as defined by the appended claims.

What is claimed is:

1. A paraffin filter system, comprising:

an AC plug and cord, said AC plug of the type pluggable into a wall outlet for powering said paraffin filter system;

an insulated case for holding the following components of said paraffin filter system, said insulated case being of a size for portability by a person;

said components including;

a) a replaceable particulate filter for receiving melted paraffin and for removing particulate matter therefrom;

b) a paraffin pump for pumping melted paraffin through said particulate filter, said paraffin pump being electrically driven for pumping the melted paraffin, and located in said insulated case so that heat generated by said paraffin pump is used with said insulated case for assisting in keeping the paraffin in a melted state; and c) a heater for heating the paraffin pump prior to operation thereof for melting residual paraffin contained in said paraffin pump.

2. The paraffin filter system of claim 1, further including a control system for controlling operation of the paraffin pump, said control system preventing operation of the paraffin pump until said paraffin pump reaches a desired operating temperature.

3. The paraffin filter system of claim 1, further including a friction connection for insertion of said particulate filter to facilitate replacement of said particulate filter.

4. The paraffin filter system of claim 3, further including in combination a particulate filter and a bacteria filter.

5. The paraffin filter system of claim 4, wherein said particulate filter and said bacteria filter are physically interchangeable in said friction connection.

6. The paraffin filter system of claim 1, further including in combination a paraffin spa.

7. A paraffin filter system, comprising:

an insulated portable case having an inner shell and an outer shell, with an air space therebetween;

said insulated case having a divider providing a first chamber and a second camber;

a paraffin pump located is said second chamber;

a heating element located in said second chamber;

a fan attached to said divider, said fan positioned for blowing air over said pump;

a friction connection mounted to said divider, and tubing coupled to said friction connection for carrying melted paraffin with respect to said pump; and a paraffin filter positioned in said first chamber and adapted for connection to said friction connection, said friction connection providing easy replaceability without using threads.

8. The paraffin filter system of claim 7, further including electronic circuits mounted to said insulated case so as to be positioned in said air space.

9. The paraffin filter system of claim 8, further including at least one manually operable switch mounted to said insulated case, said switch coupled to said electronic circuits for controlling operation of said paraffin pump.

10. The paraffin filter system of claim 7, further including in combination a particulate filter.

11. The paraffin filter system of claim 10, wherein said particulate filter has a disk-shaped body.

12. The paraffin filter system of claim 7, further including in combination a paraffin filter for filtering bacteria from the paraffin.

13. The paraffin filter system of claim 12, wherein said bacteria filter has a disk-shaped body.

14. The paraffin filter system of claim 7, further including an insulated lid for covering an opening in said insulated case.

* * * * *